US007951441B2

(12) United States Patent
Wu

(10) Patent No.: US 7,951,441 B2
(45) Date of Patent: May 31, 2011

(54) COMPOUND FLOORING AND MANUFACTURING METHOD THEREOF

(76) Inventor: Tan Bo Wu, Guangzhou (CN)

( * ) Notice: Subject to any disclaimer, the term of this patent is extended or adjusted under 35 U.S.C. 154(b) by 137 days.

(21) Appl. No.: 12/017,333

(22) Filed: Jan. 21, 2008

(65) Prior Publication Data

US 2008/0261036 A1 Oct. 23, 2008

(30) Foreign Application Priority Data

Apr. 20, 2007 (CN) ..... 2007 1 0027633

(51) Int. Cl.
*B32B 5/00* (2006.01)
*B32B 7/00* (2006.01)
*E04F 15/00* (2006.01)

(52) U.S. Cl. ..... 428/57; 52/390; 428/53; 428/98; 428/213; 428/220

(58) Field of Classification Search ..... 428/57, 428/53, 98, 213, 220, 390
See application file for complete search history.

(56) References Cited

U.S. PATENT DOCUMENTS

| | | | | |
|---|---|---|---|---|
| 4,452,604 | A * | 6/1984 | Lenox et al. | 8/471 |
| 4,694,627 | A * | 9/1987 | Omholt | 52/390 |
| 4,818,590 | A * | 4/1989 | Prince et al. | 428/213 |
| 5,091,458 | A * | 2/1992 | Santoemma | 524/436 |
| 5,424,363 | A * | 6/1995 | Nagata et al. | 525/85 |
| 6,103,333 | A * | 8/2000 | Keith | 428/99 |
| 2003/0065072 | A1 * | 4/2003 | Van Es et al. | 524/161 |

* cited by examiner

*Primary Examiner* — Brent T O'Hern
(74) *Attorney, Agent, or Firm* — Intellectual Property Law Group LLP; Juneko Jackson; Otto O. Lee

(57) ABSTRACT

The present invention relates to a compound flooring material. The compound flooring such as thermoplastic/wood compound flooring is produced by adhering two layers through adhesive cementing. According to an embodiment, a first sheet is a high quality wood veneer and the second sheet is a low foaming, environment friendly, UPVC board. The sheets are bonded by incorporating a high quality polyvinyl acetate polymer adhesive that contains no formaldehyde, thus providing a strong, safe, odorless product. The UPVC/wood compound flooring has a very low shrinking and swelling rate and is convenient and accurate to install.

9 Claims, 1 Drawing Sheet

COMPOUND FLOORING AND MANUFACTURING METHOD THEREOF

CROSS-REFERENCE TO RELATED APPLICATIONS

This application claims foreign priority under 35 U.S.C. §119 to Chinese Patent Application no. 200710027633.1, filed in the People's Republic of China on Apr. 20, 2007, the entire contents of which are hereby incorporated by reference.

BACKGROUND OF THE INVENTION

1. Field of the Invention

The present invention relates to thermoplastic compound flooring material. In particular, the present invention is a new UPVC/wood compound flooring material and manufacturing method thereof. The process represents a marked improvement in the manufacturing of compound flooring and the present invention is in many ways superior to previous generations of wood flooring.

2. Related Art

The compound floor (flooring material comprising multiple bonded layers of similar or dissimilar materials) has gained widespread acceptance in recent years. There are three basic methods for producing compound floor:

MOLDED FIBRE COMPOSITE COMPOUND FLOOR: Adhesives and additives are blended with wood pulp, then passed through high temperature, high pressure processing to become a solid molded product. This method of manufacturing overcomes the inherent instability of wood by elimination of the grain structure. However, the most commonly used adhesive in this process is formaldehyde, which is difficult to control, and often exceeds established limits in processing. This results in the continued emission of an irritating, and potentially hazardous odor after installation.

SOLID WOOD COMPOUND FLOOR: This method combines staggered layers of solid wood, with the top layer generally being a high quality hardwood, while sub-layers are of lesser quality. Some brands arrange center layers perpendicular to top and bottom layers (plywood technology) to form a more dimensionally stable product, while maintaining the look and feel of traditional solid wood flooring. This product has three general forms:

1) Three layered solid wood compound flooring;
2) Multi-layered solid wood compound flooring; and
3) New type solid wood compounding flooring.

PLASTIC SOLID WOOD COMPOUND FLOOR: This method is a new technology that combines three dissimilar layers to form a flooring material, e.g. as described in Chinese patent application 02210626.X. The top layer is usually a thin panel of high quality wood of various species. The central layer is foamed plastic shock absorbing layer, and the bottom layer is a filled PVC floor. In this type of PVC, sometimes a heavy metal like lead is used as a process aid. In such circumstances, the flooring could create a potentially hazardous product, which would be illegal in many countries.

SUMMARY OF THE INVENTION

The object of the present invention is to provide a much-improved process for the manufacture of a highly desirable compound flooring comprising an unplasticized polyvinyl chloride (UPVC) and solid wood flooring product. Much simpler that previous methods, an embodiment of the present invention incorporates two layers, and in an embodiment, only two layers comprising: a thin top layer or sheet (1) of high quality wood of any species, and a bottom layer (2) of environment friendly, low foaming thermoplastic board such as a UPVC layer. The foamed bottom UPVC board/layer of this solid wood synthetic flooring has excellent shock absorbing properties that negate the need for a third shock-absorbing layer.

The UPVC layer is processed without use of any heavy metal processing aids and is therefore an environmentally safe product. The use of a UPVC layer adds excellent dimensional stability (coefficient of expansion and contraction is very low, preventing curling and warping), efficient insulation against heat/cold, sound deadening, moisture resistance, anticorrosion, insect resistance, and fire suppression (PVC tends to be self-extinguishing). The composite flooring provides for the aesthetic appeal of the wood patterns of all wood floors. It also allows for easy and accurate installation.

Additionally, this compound flooring of the present invention allows for an 86% saving of the high quality wood used in traditional solid wood flooring, while maintaining the exact appearance of the solid wood floor, and at the same time being more durable and more comfortable underfoot.

According to an embodiment of the present invention, the UPVC/solid wood compound flooring is produced by adhering a first layer comprising a high quality wood veneer top layer to a second layer comprising a low foaming UPVC board which serves as a support, and shock absorbing layer. The first and second layers are bonded, incorporating a high quality polyvinyl acetate polymer adhesive, which contains no formaldehyde, thus providing a strong, safe, permanent, and odorless bonded product.

According to an embodiment of the present invention, the chemical make-up of the second layer comprises: PVC of 60-90 weight share, $CaCO_3$ of 5-20 weight shares, organic tin of 0-4 weight share and/or rare earth Ca—Zn composite stabilizer (La/Ca/Zn) of 1-5 weight share, Methyl Methacrylate-Butyl Acrylic-Butyl Methacrylate ternary copolymer of 5-12 weight share, PE wax of 0.1-1 weight share, stearic acid of 0.1-1 weight share, heavy metal (i.e. lead, cadmium) of less than 200 ppm. The second layer of the compound flooring according to an embodiment of the invention has the following content of inorganic elements with Atomic Emission Spectrometry: Ca>1, Zn>1, La>0.1-0.01 and/or Sn is 0.1-0.01, Al is 0.1-0.01.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
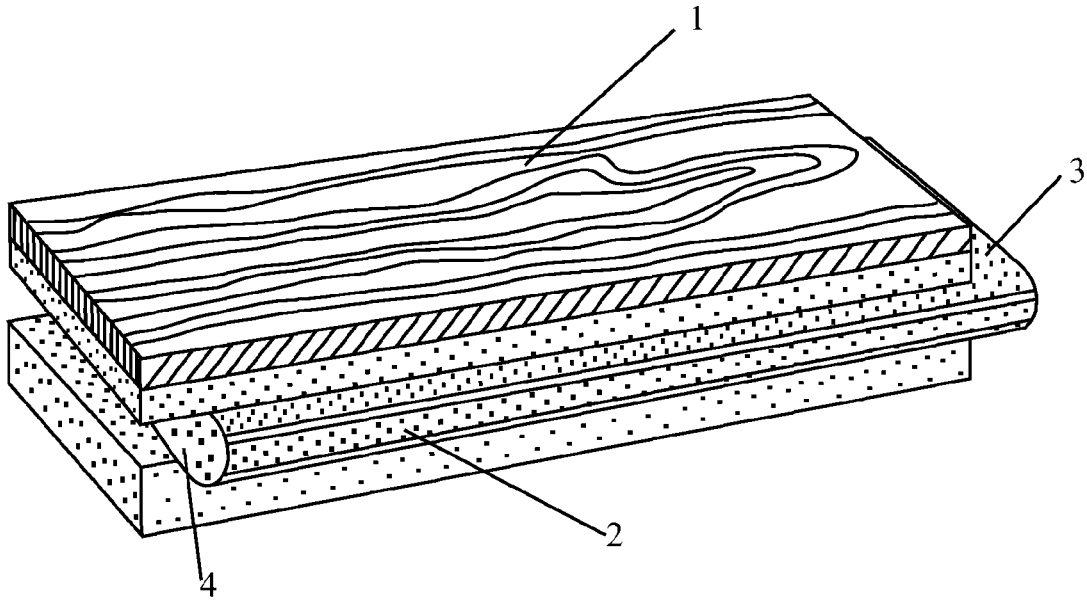
FIG. 1 is a schematic view of a tongue and groove option for installing low foaming UPVC/wood compound flooring, according to an embodiment of the present invention.

FIG. 1 shows a thermoplastic/solid wood compound flooring according to an embodiment of the present invention. The manufacture of the compound flooring comprises a first layer 1 of material adhesive bonded to a second layer 2 of different material. In particular, the first layer 1 comprises a high quality and thin wood veneer, and the second layer 2 comprises a low foaming Unplasticized Polyvinyl Chloride (UPVC) board, according to an embodiment of the present invention. The second layer 2 serves as the support and shock-absorption layer. The two layers are bonded by incorporating a high quality polyvinyl acetate polymer adhesive, which contains no formaldehyde, thus providing a strong, safe, permanent, and odorless bonded product. FIG. 1 also depicts a tongue 3 and groove 4 method of installation for this product. This is only one of the numerous possible options for installing the compound flooring product according to the present invention.

Figure 2:
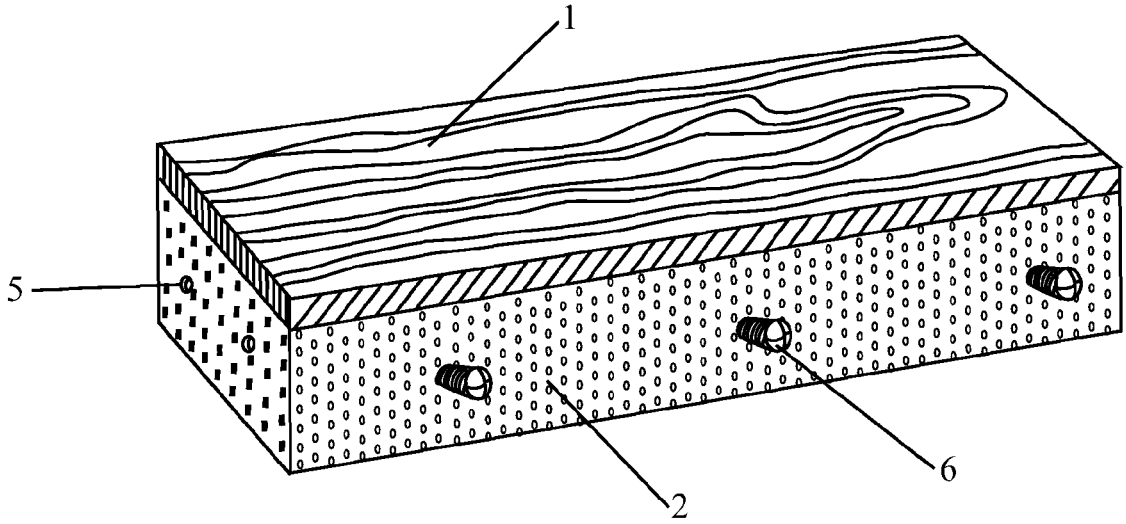
FIG. 2 illustrates an alignment pin and recessed pocket option for installing low foaming UPVC/wood compound flooring, according to an embodiment of the present invention.

FIG. 2 shows the low foaming UPVC/Wood flooring made by the adhesive bonding of two panels. First layer 1 is a thin wood veneer, and second layer 2 is a low foaming UPVC board. FIG. 2 also depicts an alignment pin 6 and recessed pocket 5 method of installation. This is only one of numerous possible options for installing the compound flooring product according to the present invention.

As discussed, while first layer 1 is a high quality wood veneer, the chemical makeup of second layer 2 comprises a number of materials. The second layer 2 is a thermoplastic such as UPVC board, having a chemical makeup comprising: PVC of 60-90 weight share, $CaCO_3$ of 5-20 weight share, organic tin of 0-4 weight share and/or earth Ca—Zn composite stabilizer (La/Ca/Zn) of 1-5 weight share, Methyl Methacrylate-Butyl Acrylic-Butyl Methacrylate ternary copolymer of 5-12 weight share, PE wax of 0.1-1 weight share, stearic acid of 0.1-1 weight share, while heavy metal (lead, cadmium) is less than 200 ppm. Under an Atomic Emission Spectrometer, the UPVC board has the following content of inorganic elements: Ca>1, Zn>1, La>0.1-0.01 and/or Sn is 0.1-0.01, Al is 0.1-0.01.

Production Method for Low Foaming UPVC/Wood Flooring

Layer 1: First layer 1 comprises of high quality wood veneer with a thickness varying from 0.5 to 5 mm, depending on lumber species, and/or the choice of the manufacturer.

TECHNICAL PROCEDURE: Selected lumber is sawed to a general size, steam degreased, and kiln dried until moisture content reaches about 7-9%. Dried lumber is then transferred to a climate-controlled chamber for 7-10 days in a temperature of 20° C. to 35° C., and humidity of 35-40%. This is a balancing and tempering procedure, necessary to stabilize the panels, and relieve internal stress developed in kiln drying operation. Panels are then cut to specific size, and the surface planed on all four sides. Then a quality control operation is applied to select color, grain patterns, etc.

Layer 2: Second layer 2 is an extruded low foaming PVC board with a general thickness of 6-13 mm.

The material composition and procedure for second panel 2 is described in the following distribution ratio, as raw materials added to machine equipment: PVC dosage is 65-125 weight share, $CaCO_3$ dosage is 3-30 weight share, Methyl Methacrylate-Butyl Acrylic-Butyl Methacrylate Ternary copolymer (or i.e. foam regulator) dosage is 3.5-21 weights share, vesicant dosage is 0.5-2.0 weight share, organic tin dosage is 0-4.0 weight share and/or the rare earth Ca—Zn composite stabilizer dosage is 3.0-8.75 weight share, PE wax dosage is 0.2-1.0 weight share, saturated fatty acid ester dosage is 0.1-0.5 weight share, stearic acid dosage is 0.1-1.0 weight share, monoglycerides dosage is 0.1-0.5 weight share, epoxy soybean oil (ESO) dosage is 0-6.5 weight share, processing additives such as acrylic resin (ACR) dosage is 0-4.0 weight share, chlorination polyethylene (CPE) dosage is 0-6.0 weight share, titanium dioxide ($TiO_2$) dosage is 0-5.0 weight share.

TECHNICAL PROCEDURE: After careful measurement of all proportions, components are introduced into a high-speed chemical blender, and mixed for 8-15 minutes. This material is then transferred to a low speed blender, where it is stirred for 5-15 minutes more. This material is next allowed to "Rest" for 24 hours; after which it is fed into a twin-screw extrusion line and processed to become the low foaming PVC board known as second layer 2. The extruder temperature parameters are as follows: screw at 140±5° C.; tooling at 175±5° C.; and feed-spout at 180±5° C.

Panel Compounding: High quality waterproof polyvinyl acetate adhesive (containing no formaldehyde or triphenyl) is applied to a top surface of low foaming PVC board (second layer 2) at a rate of 200-300 g/$m^2$. First layer 1 is joined to second layer 2 in a fixture, then introduced into a heated, high frequency press, where permanent bonding of the two layers/panels is accomplished through thermo compression, thus shaping the semi-finished flooring product. The bonded panels are again tempered in a climate-controlled chamber before proceeding to the next stage.

Intensive Processing: According to the desire/requirements of the manufacturer, milling is now done to give the flooring its finished shape, including numerous possible configurations for installation apparatus (tongue and groove, etc).

Surface Finishing and Processing: At this stage, flooring is complete except for sanding, and application of a tough, durable wood finish.

EXAMPLE 1

In one embodiment of the present invention, the method of production of the compound flooring is as follows: Take 2 $m^3$ nanmu and place into a drying kiln for drying. The selected wood of required specification is added into the drying kiln for steam degreasing. The drying kiln serves to help eliminate internal stress and reduce physiological water. To reach 7.5% of the moisture content of nanmu, quench and temper it in a balanced storehouse. Store for 10 days at 20-35° C. under 35-40% humidity. Then process the wood into a solid sheet for standby according to a thickness of 0.5 mm. For instance, the wood is sawed into pieces with a thickness of 0.5 mm.

As raw materials added to machine equipment: weigh out PVC 65 kg, $CaCO^3$ 6 kg, Methyl Methacrylate-Butyl Acrylic-Butyl Methacrylate Ternary copolymer 8 kg, Azodicarbonamide vesicant 0.8 kg, Organic tin 1.2 kg, rare earth Ca—Zn composite stabilizer 3.0 kg, PE wax 0.2 kg, stearic acid (HST) 0.2 kg, monoglycerides 0.1 kg, saturated fatty acid ester 0.1 kg, ESO 2.0 kg, ACR 2.0 kg, $TiO_2$ 2.0 kg. Add these components into a high-speed churn-dasher with high speed mixing for about 10 minutes and then remove the materials (temperature is maintained between 115-120° C.). Place the materials into a low speed churn-dasher to stir for about 15 minutes, and remove. Shift the blended material into the store tank to deposit for 24 hours. Then add the material to a PVC plate double screw rod for extrusion to produce a low foaming UPVC board 2.

The double screw extrusion process temperature of PVC sheet is set as follows: screw temperature is 145° C., mold temperature is set at 175±5° C., and a barrel temperature in areas no. one through no. five is all 180±5° C. Place the low foaming UPVC board 2 for standby at normal temperature.

First, the low foaming UPVC board 2 is provided with 220 g polyvinyl acetate polymer adhesive to each square meter. The board 2 is glued to form the semi-finished product with the nanmu faceplate of the same area, and the thickness of the nanmu faceplate is 0.5 mm. Third, the board 2 is exposed to a high frequency hot press for processing of high-frequency hot molding. Fourth, the tenon and groove structure is formed on the low foaming UPVC board 2 according to dimensions. Then, paint is applied to the bottom and to the surface, and light processing is applied to arrive at a finished product.

EXAMPLE 2

In another embodiment of the present invention, the method of production of the compound flooring is as follows: Take 2 $m^3$ nanmu, and place it into a drying kiln for drying. The selected wood of required specification is added into the drying kiln for steam degreasing. The drying kiln helps eliminate internal stress and reduce physiological water. To reach 7.5% of the moisture content of nanmu, quench and temper in a balanced storehouse. Store for 10 days at 20-35° C. under 35-40% humidity. Then process the wood into a solid sheet for standby according to a thickness of 3 mm. For instance, the wood is sawed into pieces with a thickness of 3 mm.

As a raw materials composition added to machine equipment: weigh out PVC (K=56) 100 kg, $CaCO_3$ 20 kg, Methyl Methacrylate-Butyl Acrylic-Butyl Methacrylate Ternary copolymer 18 kg, azodicarbonamide vesicant 1.8 kg, organic tin 3.5 kg, PE wax 1.0 kg, monoglycerides 0.6 kg, stearic acid (HST) 0.3 kg, saturated fatty acid ester 0.3 kg, ESO 4.0 kg, CPE 4.0 kg. Add these components into a high-speed churn-dasher with high speed mixing for about 10 minutes and then remove the materials (temperature is maintained between 115-120° C.). Place the materials into a low speed churn-dasher to stir for about 15 minutes and then remove. Shift the blended material in a store tank to deposit for about 24 hours and add the material to a PVC plate double screw rod for extrusion to produce low foaming UPVC board 2.

The double screw extrusion process temperature of PVC sheet is set as follows: screw temperature is 145° C., mold temperature set at 175±5° C., and a barrel temperature in areas no. one through no. five is all 180±5° C. Produce the low foaming UPVC board 2 and place for standby at normal temperature.

First, the low foaming UPVC board 2 is provided with 280 g polyvinyl acetate polymer adhesive to each square meter. The board 2 is glued to form the semi-finished product with the nanmu faceplate of the same area, and the thickness of the nanmu faceplate is 3 mm. Third, the board is exposed to high frequency hot press for processing of high-frequency hot molding. Fourth, the tenon and groove structure or the recessed pocket and pin structure is formed on the low foaming UPVC board 2 according to dimensions. Then, paint is applied to the bottom and to the surface, and light processing is applied to arrive at a finished product.

EXAMPLE 3

In another embodiment of the present invention, the method of production of the compound flooring is as follows: Take 2 $m^3$ rosewood and place into a drying kiln for drying. The selected wood of required specification is added into the drying kiln for steam degreasing. The drying kiln helps eliminate internal stress and reduce physiological water. To reach 8% of the moisture content in the rosewood, quench and temper it in a balanced storehouse. Store for 10 days at 20-35° C. under 35-40% humidity. Then process the wood into a solid sheet for standby according to a thickness of 0.5 mm for sawing patch. For instance, the wood is sawed into pieces with a thickness of 3 mm.

As raw materials added to machine equipment: weigh out PVC (K=56) 125 kg, $CaCO_3$ 30 kg, Methyl Methacrylate-Butyl Acrylic-Butyl Methacrylate Ternary copolymer 21 kg, $NaHCO_3$ modified vesicant 2.0 kg, rare earth Ca—Zn composite stabilizer 8.75 kg, PE wax 1.0 kg, stearic acid (HST) 0.2 kg, saturated fatty acid ester 0.4 kg, ESO 5.0 kg, ACR 2.0 kg, $TiO_2$ 3.0 kg. Add these components into a high-speed churn-dasher with high speed mixing for about 10 minutes and then remove the materials (temperature is maintained between 115-120° C.). Place the materials into a low speed churn-dasher to stir for about 15 minutes, and then remove. Shift the blended materials into a store tank to deposit for 24 hours, and then add the material to a PVC plate double screw rod for extrusion to produce low foaming UPVC board 2.

The double screw extrusion process temperature of PVC sheet is set as follows: screw temperature is 145° C., mold temperature is set at 175±5° C., and a barrel temperature in areas no. one through no. five is all 180±5° C. Place the low foaming UPVC board for standby at normal temperature.

First the low foaming UPVC board 2 is provided with 260 g polyvinyl acetate polymer adhesive to each square meter. The board 2 is glued to form the semi-finished product with the rosewood faceplate of the same area, and the thickness of the rosewood faceplate is 5 mm. Third, the board is exposed to a high frequency hot press for processing of high-frequency hot molding. Fourth, the tenon and groove structure or hollowness and convex nails structure is opened on the low foaming UPVC board 2 according to dimensions. Then, paint is applied to the bottom and to the surface, and light processing is done to arrive at a finished product.

Using methods of gas chromatography in conjunction with mass spectrometry, mass spectrometry, infrared spectroscopy, X-ray diffraction etc., the material componential content of the second layer 2 of the compound flooring according to an embodiment, is detected as follows in the finished product: PVC is 60-90 weight share, $CaCO_3$ is 5-20 weight share, organic tin is 0-4 weight share or/and rare earth Ca—Zn composite stabilizer (La/Ca/Zn) is 1-5 weight share, Methyl Methacrylate-Butyl Acrylic-Butyl Methacrylate ternary copolymer is 5-12 weight share, PE wax is 0.1-1 weight share, stearic acid is 0.1-1 weight share, heavy metal (lead, cadmium) is less than 200 ppm. In addition, the second layer 2 of the solid wood/UPVC synthetic flooring of the present invention has been analyzed to have the following content of inorganic elements with Atomic Emission Spectrometry: Ca>1, Zn>1, La>0.1-0.01 and/or Sn is 0.1-0.01, Al is 0.1-0.01.

The UPVC/wood compound flooring according to embodiments of this invention only uses about 14% of the wood found in pure natural wood flooring and maintains the same grade and quality as a high quality solid wood flooring. In addition, the manufacturing cost for the compound flooring is 40% less than the manufacturing cost for solid wood flooring.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

I claim:

1. A compound flooring of only two non-adhesive layers comprising: a top layer of wood veneer and a bottom layer of a low foaming unplasticized polyvinyl chloride (UPVC), the bottom layer processed without heavy metal processing aids and having a thickness ranging from about 6 to about 13 mm, wherein the bottom layer is bonded only to the top layer with a polyvinyl acetate polymer adhesive containing no formaldehyde and no triphenyl wherein the bottom layer comprises a material composition in a finished state of the following:

a PVC between about 60 to 90 weight share;

a $CaCO_3$ between about 5 to 20 weight share;

a Methyl Methacrylate-Butyl Acrylic-Butyl Methacrylate Ternary copolymer between about 5 to 12 weight share;

an organic tin between about 0 to 4.0 weight share, or a rare earth composite stabilizer between about 1 to 5 weight share;

PE wax between about 0.1 to 1.0 weight share;

a stearic acid between about 0.1 to 1.0 weight share.

2. The compound flooring of claim 1, wherein a thickness of said top layer ranges from about 0.5 to about 5 mm.

3. The compound flooring of claim 1, wherein the material composition in a finished state comprises an organic tin between about 0.1 to 4.0 weight share and a rare earth composite stabilizer between about 1 to 5 weight share.

4. The compound flooring of claim 1, wherein the bottom layer has less than 200 ppm of heavy metal.

5. The compound flooring of claim 1, wherein the UPVC comprises a rare earth composite stabilizer of La/Ca/Zn.

6. The compound flooring of claim 1, wherein the bottom layer in a finished state, has an inorganic element content weight share of Ca>1, Zn>1, La>0.01 and/or Sn between 0.01-0.10, and Al between 0.01-0.10.

7. The compound flooring of claim 1, wherein the two layers are adhered together and configured to have a tongue and groove configuration for installation.

8. The compound flooring of claim 1, wherein the bottom layer comprises a plurality of recessed pockets to provide for a pin and recessed pocket configuration for installation.

9. The compound flooring of claim 1, wherein the polyvinyl acetate polymer adhesive that bonds the top layer to the bottom layer has a concentration of about 200-300 $g/m^2$.

* * * * *